US006287091B1

(12) United States Patent
Svihla et al.

(10) Patent No.: US 6,287,091 B1
(45) Date of Patent: Sep. 11, 2001

(54) TURBOCHARGER WITH NOZZLE RING COUPLING

(75) Inventors: Gary R Svihla, Clarendon Hills; John R. Zagone, Westmont, both of IL (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/567,879

(22) Filed: May 10, 2000

(51) Int. Cl.[7] ..... F04B 17/00

(52) U.S. Cl. ..... 417/407; 415/209.1; 415/211.2; 415/189; 415/211; 415/209.2; 415/170.1

(58) Field of Search ..... 417/407; 415/209.2, 415/208.4, 208.2, 209.1, 211.2, 212.1, 189, 170.1, 211

(56) References Cited

U.S. PATENT DOCUMENTS 3,778,194 * 12/1973 Miller et al. ..... 417/407
4,392,778 * 7/1983 Bless ..... 415/189
4,492,517 * 1/1985 Klompas ..... 415/189
5,129,783 * 7/1992 Hayton ..... 415/209.2
5,807,072 * 9/1998 Payling ..... 415/170.1
5,868,553 * 2/1999 Battig et al. ..... 415/189
6,168,375 * 1/2001 LaRue et al. ..... 415/211

* cited by examiner

*Primary Examiner*—Thomas Denion
*Assistant Examiner*—Thai-Ba Trieu
(74) *Attorney, Agent, or Firm*—Cary W. Brooks

(57) ABSTRACT

A turbocharger includes a rotor having coaxial turbine and compressor wheels. In a preferred embodiment, a turbine inlet scroll conducts exhaust gas toward the turbine wheel and an exhaust duct carries exhaust gas away from the turbine wheel. A turbine nozzle ring coupled between the inlet scroll and the exhaust duct defines an annular passage including angled stator blades and vanes that direct gas angularly against energy converting blades of the turbine wheel. Ring seals at outer and inner edges of the nozzle ring inlet end seal the inlet end against loss of gas pressure. They may also form springs that axially bias the nozzle ring against a stop to fix the axial position of the nozzle ring. The nozzle ring is centered by radial guides at the outlet end which may include at least three radial keys on the nozzle ring engaging mating guide slots connected with the exhaust duct. The guides maintain axial alignment of the nozzle ring and an integral shroud with the rotor axis while accommodating relative thermal growth of the connected components.

7 Claims, 3 Drawing Sheets

TURBOCHARGER WITH NOZZLE RING COUPLING

TECHNICAL FIELD

This invention relates to engine exhaust driven turbochargers and more particularly to a turbocharger with a turbine nozzle ring axially aligned by coupling means including radial guides.

BACKGROUND OF THE INVENTION

It is known in the art to provide an engine turbocharger with a nozzle ring having stator blades that direct entering exhaust gas angularly against energy converting blades of a turbine wheel. The nozzle ring may also include a shroud surrounding the turbine wheel. Simple coupling means are desired for mounting of a turbocharger nozzle ring in a manner to maintain axial alignment with the turbine wheel while permitting relative thermal expansion of the connecting components.

SUMMARY OF THE INVENTION

The present invention provides an engine turbocharger having a turbine nozzle ring that defines an annular passage. An inlet end of the nozzle ring is positioned to receive exhaust gas from turbine inlet means such as an inlet scroll. An outlet end of the nozzle ring includes a shroud closely surrounding the turbine wheel. Stator blades are provided between the ends for directing exhaust gas angularly against energy converting blades of the turbine wheel.

In a preferred embodiment, the nozzle ring includes seal rings at its inlet end to seal inner and outer edges of the nozzle ring against leakage of pressurized exhaust gas. Preferably, the seal rings also act as axial springs to bias the outlet end of the nozzle ring against a nozzle retainer assembly, which acts as a stop. At the outlet end of the nozzle ring, radial guides centered on the axis of the turbocharger rotor engage radial guide means connected with an associated exhaust duct to maintain axial alignment of the nozzle ring with the axis of the rotor. The guides are preferably key and slot means acting between the connecting members. At least three radially directed keys may be provided on the nozzle ring. The keys are engagable with mating radial slots formed in a support carried by the exhaust duct with which the nozzle ring is connected. The radial guides provide the sole means of alignment and support of the nozzle ring with no need for pilots or other alignment aids. When exhaust gas has passed through the turbine shroud and turbine blades, openings in the exhaust duct allow the hot exhaust gas to circulate around the members supporting the nozzle ring in order to minimize thermal gradients between the nozzle ring flanges and vanes or stator blades.

These and other features and advantages of the invention will be more fully understood from the following description of certain specific embodiments of the invention taken together with the accompanying drawings.

DESCRIPTION OF THE PREFERRED EMBODIMENT

Figure 1:
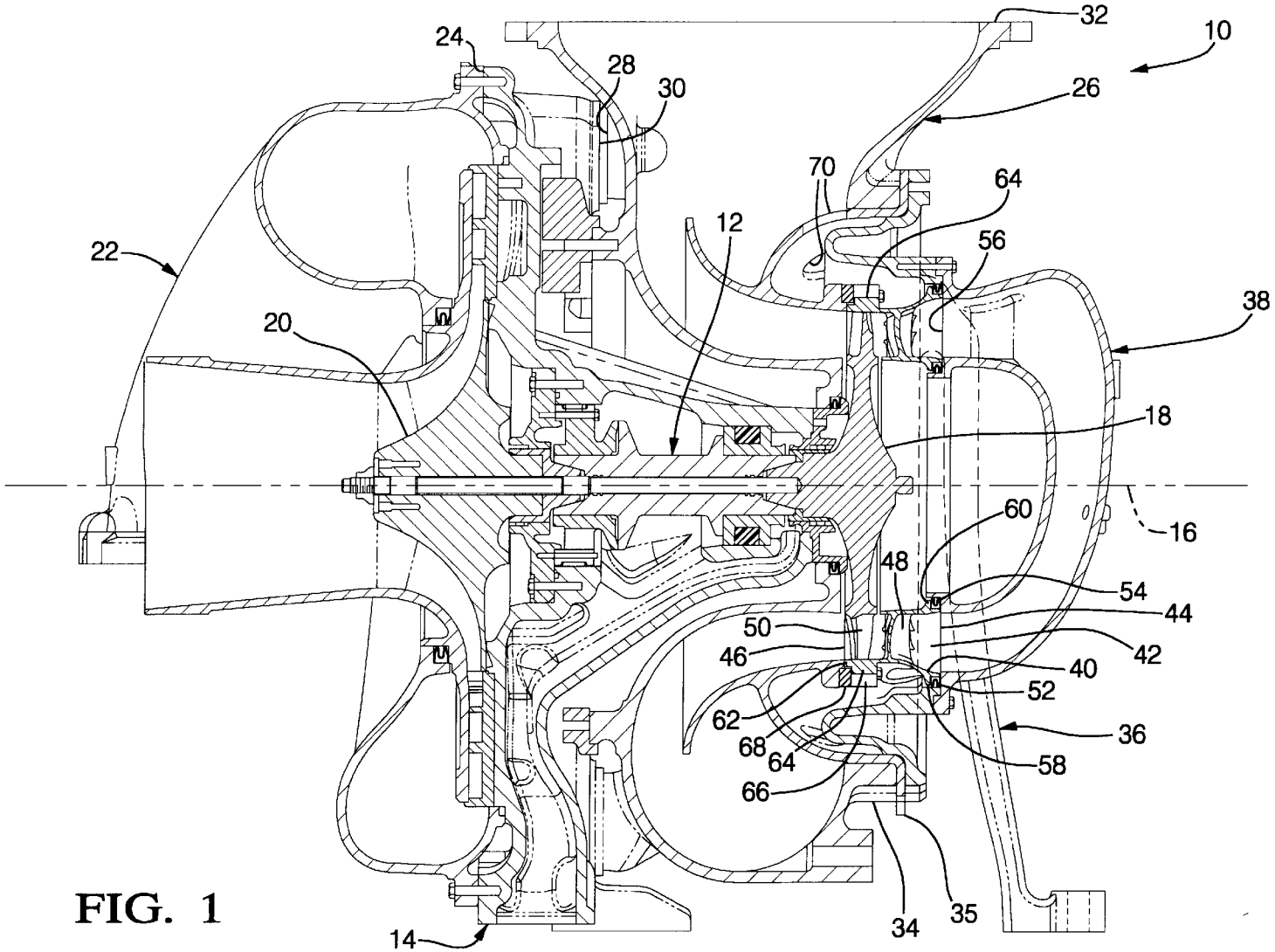
FIG. 1 is a cross-sectional view of an engine turbocharger having nozzle ring coupling means in accordance with the invention.
Figure 2:
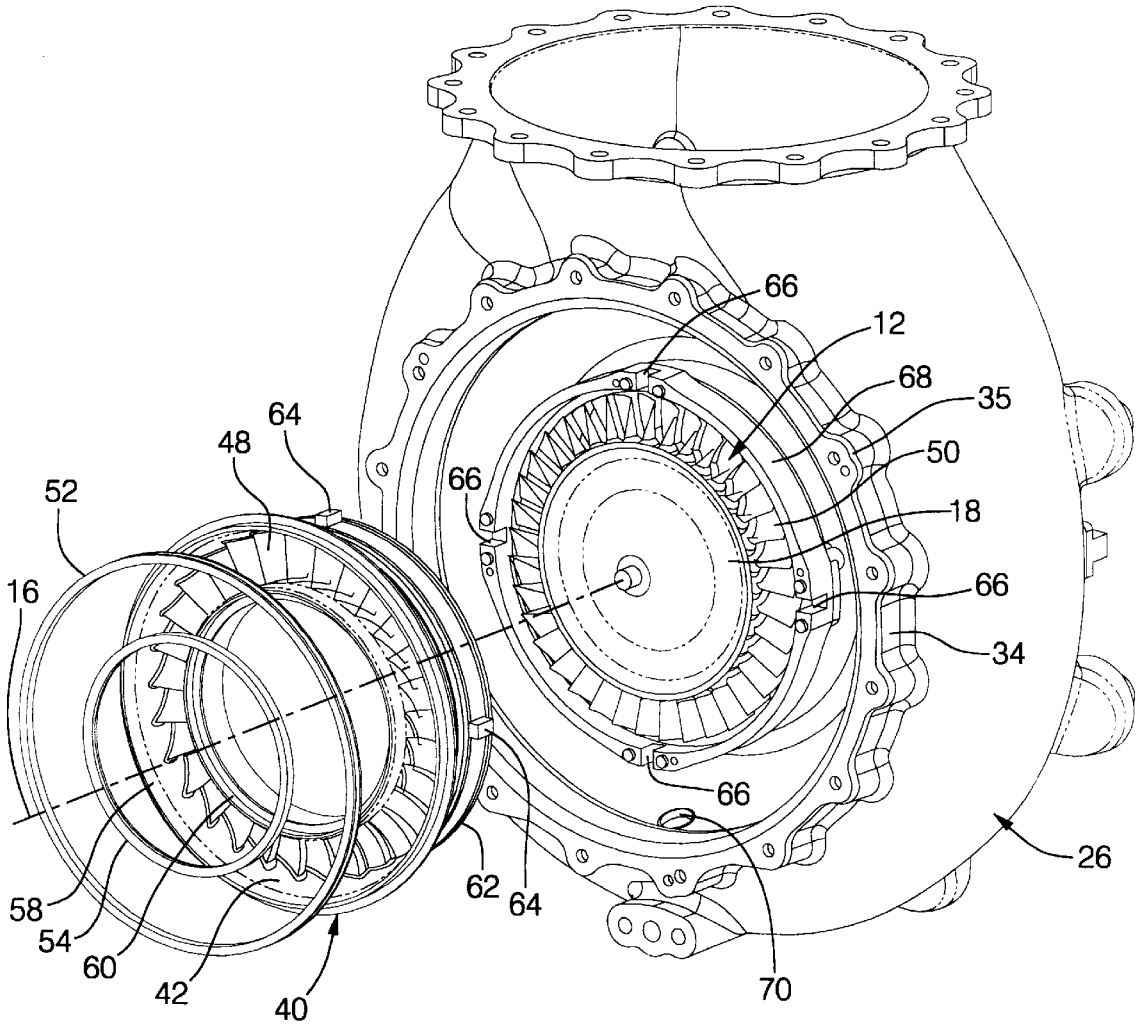
FIG. 2 is an exploded pictorial view illustrating assembly of the nozzle ring and seals with an associated exhaust duct and turbine assembly.
Figure 3:
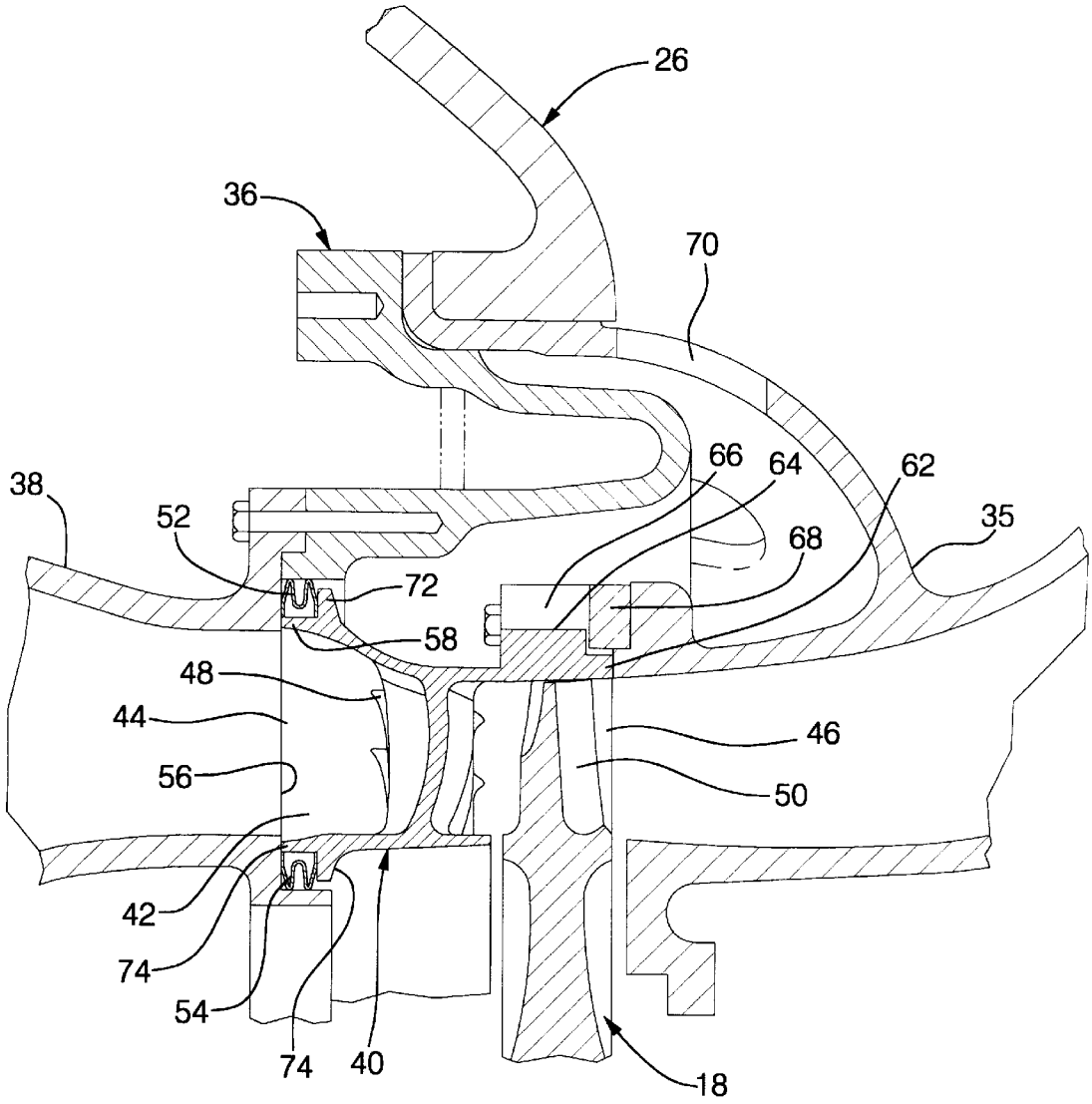
FIG. 3 is an enlarged cross-sectional view through a portion of the nozzle ring and associated structure.

Referring now to the drawings in detail, numeral 10 generally indicates an exhaust driven turbocharger for an engine, such as a diesel engine intended for use in railway locomotives or other applications of medium speed diesel engines. Turbocharger 10 includes a rotor 12 carried by a rotor support 14 for rotation on a longitudinal axis 16 and including a turbine wheel 18 and a compressor wheel 20. The compressor wheel is enclosed by a compressor housing assembly 22 including components which are supported on an axially facing first side 24 of the rotor support 14. An exhaust duct 26 has a compressor end 28 that is mounted on a second side 30 of the rotor support 14 spaced axially from the first side 24.

The exhaust duct 26 is physically positioned between the rotor support 14 and the turbine wheel 18 to receive exhaust gases passing through the turbine wheel and carry them to an exhaust outlet 32. A turbine end 34 of the exhaust duct 26 and an associated nozzle retainer assembly 35 are separately supported by an exhaust duct support 36 that is connected with the exhaust duct 26 at the turbine end 34. The exhaust duct support 36 also supports a turbine inlet scroll 38 which receives exhaust gas from the associated engine and directs it through a nozzle ring 40 to the turbine wheel 18 for transferring energy to drive the turbocharger compressor wheel 20.

The nozzle ring 40 defines an annular passage 42 extending from an inlet end 44 to an outlet end 46 of the nozzle ring. Between the ends 44, 46, stator blades or vanes 48 are provided which direct exhaust gas angularly against energy converting blades 50 of the turbine wheel 18.

At the inlet end 44, the nozzle ring carries outer and inner seal rings 52, 54 formed as reusable convoluted high temperature metal springs. The seal rings 52 54 are compressed axially between an outlet end 56 of the turbine inlet scroll 38 and outer and inner flanges 58, 60 of the nozzle ring. The seal rings 52, 54 serve the dual purposes of axially sealing the radial clearances against the escape of pressurized exhaust gas entering the nozzle ring from the turbine inlet scroll 38 and of providing axial force against the inlet end 44 of the nozzle ring. At its outlet end 46 the nozzle ring includes a shroud 62, which extends around the turbine wheel 18 in close proximity to the turbine blades 50 so as to limit the bypassing of exhaust gas around the ends of the turbine blades. The end of the shroud 62 is forced axially against the nozzle retainer assembly by the biasing force of the seal rings 52, 54 as well as by the axial force of exhaust gas passing through the stator blades 48, with the nozzle retainer assembly 35 acting as a stop fixing the axial position of the nozzle ring at all times.

On the outside of the shroud 62, are four radially outwardly projecting keys 64 which have axially parallel sides and are arranged in two pairs aligned on two transverse planes, not shown, extending normal to one another and intersecting at the axis 16 which lies in both of the planes. In assembly, the four keys 64 are received in four mating slots 66 formed in a slotted guide ring 68 which is secured to the nozzle retainer assembly 35 mounted at the turbine end 34 of the exhaust duct 26. The nozzle retainer assembly 35 includes openings 70 for circulating spent exhaust gas to the outside of nozzle ring 40.

In operation, exhaust gas passing from the turbine inlet scroll 38 is conducted through the nozzle ring 40 and stator blades 48 which direct the exhaust gas angularly against the turbine blades 50. The shroud 62 at the outlet end of the nozzle ring minimizes the passage of exhaust gas other than through the turbine blades so that energy is efficiently imparted to the turbine.

The nozzle ring is constrained by the four keys 64 which extend into the mating slots 66 of guide ring 68. The key and slot coupling maintains concentricity of the nozzle ring 40 with the turbine wheel 18 during thermal expansion and contraction of these components as well as of the supporting guide ring 68, the connecting nozzle retainer assembly 35, the exhaust duct support 36 and the exhaust duct 26. The force of exhaust gas acting against the stator blades 48 and the axial spring force of the seals 52, 54 urge the nozzle ring 40 forward in the direction of the turbine blades 50.

The nozzle ring is positioned by engagement of the shroud 62 with the inlet end of the nozzle retainer assembly 35, which comprises a fixed exhaust diffuser guiding exhaust gas efficiently into the exhaust duct 26. When in the exhaust duct, the spent exhaust gas is able to pass through openings 70 formed in the retainer assembly 35 which allow the hot gas to circulate around the outer sides of the nozzle ring 40 and the slotted guide ring 68. This helps minimize thermal gradients between the nozzle ring flanges 70, 72 and the stator blades 48.

While the nozzle ring embodiment disclosed utilizes two pairs of oppositely arranged radial keys and associated slots, the arrangement could be supported by a minimum of three radially arranged keys and slots if desired. The system of radial keys and slots provides guides which are the sole means of alignment and support of the nozzle ring relative to the associated turbine wheel. The keys maintain the nozzle ring always concentric with the central axis 16 while allowing relative expansion and contraction of the ring and its associated components as the parts are heated and cooled during operation or non-operation of the turbocharger.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A turbocharger comprising:

a rotor rotatable on an axis and including coaxial turbine and compressor wheels;

a turbine inlet means configured to conduct engine exhaust gas to adjacent the turbine wheel;

an exhaust duct means configured to conduct turbine exhaust gas from the turbine;

a turbine nozzle ring defining an annular passage having an inlet end positioned to receive exhaust gas from the turbine inlet means, an outlet end closely surrounding the turbine wheel and stator blades between the ends for directing exhaust gas angularly against energy converting blades of the turbine wheel;

the nozzle ring outlet end including at least three radial guides centered on the axis and engaging radial guide means connected with the exhaust duct to maintain axial alignment of the nozzle ring with the axis of the rotor; and seal means at inner and outer edges of the nozzle ring inlet end to seal the edges against leakage of pressurized exhaust gas.

2. The turbocharger as in claim 1 wherein said radial guides comprise radially projecting keys on said outlet end of the nozzle ring and said radial guide means comprise cooperating radial slots formed in support means carried by the exhaust duct means.

3. the turbocharger as in claim 2 wherein the seal means comprise axial springs that bias the nozzle ring axially against a stoop.

4. A turbocharger comprising:

a rotor rotatable on a axis and including coaxial turbine and compressor wheels;

a turbine inlet scroll configured to conduct engine exhaust gas to adjacent the turbine wheel;

an exhaust duct configured to conduct turbine exhaust gas from the turbine wheel;

a turbine nozzle ring defining an annular passage having an inlet end positioned to receive exhaust gas from the turbine inlet scroll, an outlet end closely surrounding the turbine wheel and stator blades between the ends for directing exhaust gas angularly against energy converting blades of the turbine wheel;

the nozzle ring outlet end including at least three radial guides centered on the axis and an engaging radial guide connected with the exhaust duct to maintain axial alignment of the nozzle ring with the axis of the rotor; and wherein there are two pairs each comprising a radial guide centered on the axis and an engaging radial guide connected to the exhaust duct, one pair aligned on a first transverse plane including the axis and the other pair aligned on a second transverse plane including the axis and lying normal to the first plane.

5. The turbocharger as in claim 4 wherein said radial guides comprise radially projecting keys on said outlet end of the nozzle ring and said radial guide connected to the exhaust duct comprises cooperating radial slots formed in a support carried by the exhaust duct.

6. The turbocharger as in claim 5 wherein said support comprises a slotted guide ring mounted to the exhaust duct.

7. The turbocharger as in claim 4 further including a seal at inner and outer edges of the nozzle ring inlet end to seal the edges against leakage of pressurized exhaust gas wherein the seal comprises axial springs that bias the nozzle ring axially against a stop.

* * * * *